US005760326A

United States Patent [19]

Ishibashi

[11] Patent Number: 5,760,326

[45] Date of Patent: Jun. 2, 1998

[54] TONE SIGNAL PROCESSING DEVICE CAPABLE OF PARALLELLY PERFORMING AN AUTOMATIC PERFORMANCE PROCESS AND AN EFFECT IMPARTING, TUNING OR LIKE PROCESS

[75] Inventor: Susumu Ishibashi, Hamamatsu, Japan

[73] Assignee: Yamaha Corporation, Hamamatsu, Japan

[21] Appl. No.: 700,122

[22] Filed: Aug. 20, 1996

Related U.S. Application Data

[63] Continuation of Ser. No. 170,013, Dec. 20, 1993, abandoned.

[30] Foreign Application Priority Data

Dec. 21, 1992 [JP] Japan ..... 4-356842

[51] Int. Cl.[6] ..... G10H 1/02; G10H 1/38; G10H 1/46

[52] U.S. Cl. ..... 84/626; 84/633; 84/668; 84/669; 84/DIG. 22

[58] Field of Search ..... 84/609–614, 626–638, 84/649–652, 662–669, 453, 454

[56] References Cited

U.S. PATENT DOCUMENTS

| | | | |
|---|---|---|---|
| 4,280,387 | 7/1981 | Moog | 84/454 X |
| 4,688,464 | 8/1987 | Gibson et al. | 84/454 |
| 4,829,872 | 5/1989 | Topic et al. | 84/453 |
| 4,895,060 | 1/1990 | Matsumoto | 84/454 X |
| 4,928,563 | 5/1990 | Murata et al. | 84/454 X |
| 4,991,484 | 2/1991 | Kawashima | 84/454 X |
| 5,157,215 | 10/1992 | Nakae et al. | 84/634 X |
| 5,194,682 | 3/1993 | Okamura et al. | 84/626 X |
| 5,252,774 | 10/1993 | Hasebe et al. | 84/626 X |
| 5,281,755 | 1/1994 | Matsui et al. | 84/626 X |
| 5,283,388 | 2/1994 | Shimada | 84/626 X |
| 5,410,603 | 4/1995 | Ishiguro et al. | 84/626 |
| 5,583,308 | 12/1996 | Owen | 84/626 X |

FOREIGN PATENT DOCUMENTS

| | | |
|---|---|---|
| 2-171799 | 7/1990 | Japan . |
| 4-242291 | 8/1992 | Japan . |

*Primary Examiner*—Stanley J. Witkowski
*Attorney, Agent, or Firm*—Graham & James

[57] ABSTRACT

An automatic performance section and an effect imparting section or (and) a pitch measuring section are provided in combination within a single device, and the operations of these sections are collectively controlled by a processor. To an external sound signal input from outside the device, the effect imparting section imparts an effect designated by designating data. For tuning purposes, the pitch measuring section detects zero-cross points of the external sound signal to measure the pitch of the signal. Under the control of the processor, the automatic performance section, which has automatic performance data and change data stored therein, under the control of the processor, reads out the performance data to perform an automatic performance process and also reads out the change data for changing the designating data to thereby change an effect to be imparted. In addition, there may be provided a process order control section which controls the order of the processes in the pitch measuring and automatic performance sections in such a manner that the zero-cross detecting process in the pitch measuring section is performed with priority over the process in the automatic performance section and that the process in the automatic performance section is performed with priority over a pitch calculating process in the pitch measuring section.

33 Claims, 7 Drawing Sheets

TONE SIGNAL PROCESSING DEVICE CAPABLE OF PARALLELLY PERFORMING AN AUTOMATIC PERFORMANCE PROCESS AND AN EFFECT IMPARTING, TUNING OR LIKE PROCESS

RELATED APPLICATION DATA

This application is a continuation of application Ser. No. 08/170,013, filed on Dec. 20, 1993, now abandoned.

BACKGROUND OF THE INVENTION

This invention generally relates to a tone signal processing device for performing a variety of processes on a tone signal or tone-related data, and more particularly it relates to a tone signal processing device which is provided with a combination of functions as an effect imparting device which inputs thereto a tone signal generated from an external musical instrument such as an electric guitar to impart a desired tonal effect to the tone signal or a tuning device which detects the pitch of a tone signal input from such an external musical instrument, and as an automatic performance device which performs an automatic performance on the basis of automatic performance data.

As tone signal processing devices capable of performing a variety of processes on a tone signal generated from an electric musical instrument such as an electric guitar, there are known effect imparting devices (effectors) and tuning devices (tuners) and the like.

The effectors inputs thereto a tone signal generated from an electric musical instrument such as an electric guitar and impart the input tone signal various tonal effects such as distortion, chorus and reverb. The effectors have plural effect programs (sets of data indicating different effect types and associated parameters) stored therein in advance, by means of which a player (user) can select any desired effect to be set in and achieved by the device. In the past, to selectively set a desired effect in the effector, there were no other ways available than making direct, manual manipulation of a program setting operator provided on a casing of the effector, or than inputting a MIDI (musical instrument digital interface) program change command from an external instrument such as an external automatic performance device or a foot controller that is connected with the effector via a MIDI interface.

But, it was often very difficult for the player to make such direct, manual manipulation of the program setting operator in an attempt to change the effect programs during performance on an electric guitar or the like. Thus, in many cases, desired effect changes were achieved by operating a foot switch connected with the effector via a MIDI interface and thereby giving a program change command to the effector. In recent years, tone signal processing devices have appeared in which an effector and a foot switch are integrally incorporated.

It is known that the tuning devices input thereto an analog tone signal generated from an electric musical instrument such as an electric guitar to detect the pitch of the input tone signal, then determines how much the detected pitch is different or offset from a reference pitch and then displays the pitch difference determined. Thus, the tuning devices allow the player (user) to accurately tune the musical instrument by referring to the displayed pitch difference. In Japanese Patent Laid-open Publication No. HEI 2-171799, for instance, there is disclosed a technique of detecting zero-cross points of an input tone signal from outside to determine its pitch for tuning purposes.

Further, automatic performance devices are known as devices having the function of performing various processes on tone-related data. In such automatic performance devices, previously stored performance data are read out in sequence so that performance tones are automatically reproduced on the basis of the performance data. It has also been conventionally known to use an automatic performance device and an effector in combination. For such a combined use, program change data are inserted in advance in automatic performance data to be stored in the automatic performance device, and the automatic performance device is connected with the effector via a MIDI interface, so that, as the automatic performance progresses, program change data is read out and pr ovided to the effector. With such arrangements, effect program for the effect or can be automatically changed in synchronization with the progression of the automatic performance. Japanese Patent Laid-open Publication No. HEI 4-242291, for instance, discloses that effect change data are stored in advance in combination with automatic performance data so as to change effects in synchronization with the progression of an automatic performance.

With the above-mentioned prior art, however, the effector and the automatic performance device are separate devices, and hence, to allow the two devices to operate in synchronization with each other, there was no other way available than connecting the devices via a MIDI interface for data exchange therebetween. This required cumbersome operations and was very inconvenient.

It is also known in the art to merely combine an automatic performance device and a tuning device into an integral tone signal processing device. But, such a tone signal processing device can only work in either one of automatic performance mode and tuning mode, not in the two modes simultaneously. Thus, it was not possible for the tone signal processing device to perform a tuning process while carrying out an automatic performance process. This was very inconvenient.

SUMMARY OF THE INVENTION

It is therefore an object of the present invention to provide a tone signal processing device which is provided with both an automatic performance process function and an effect impartment process function and is capable of performing these two functions simultaneously in a parallel fashion.

It is another object of the present invention to provided a tone signal processing device which is provided with both an automatic performance process function and a tuning process function and is capable of performing these two functions simultaneously in a parallel fashion.

It is still another object of the present invention to provided a tone signal processing device which is capable of performing an improved automatic performance process, effect impartment process or tuning process.

In order to achieve the above-mentioned object, a tone signal processing device in accordance with one aspect of the present invention comprises a single processor for controlling various operations of the tone signal processing device, an effect imparting section for, under the control of the processor, imparting an effect designated by designating data, to a sound signal input from outside the processing device, the effect imparting section being capable of changing an effect to be imparted to the sound signal by changing the designating data, and an automatic performance section including a storage device for storing automatic performance data and also storing change data for instructing a change in the designating data, the automatic performance section reading out stored data from the storage device under the control of the processor.

This tone signal processing device is arranged in such a manner that both the effect imparting section and the automatic performance section are control led by a single processor, and the device integrally incorporates therein these two sections.

The processor may comprise a general-purpose processor such as a microprocessor. The effect imparting section imparts an effect designated by the designating data to a sound signal input from outside the tone signal processing device. In the storage device of the automatic performance section, there are stored performance data related to an automatic performance and also change data instructing a change in the designating data. The automatic performance data are tonal data such as tone pitch data, tone generation timing data etc.

For instance, the effect imparting section may include a DSP (digital signal processor) device, in which case the designating data may comprise microprogram data that designates selected one of various operations of the DSP device. Microprograms for designating effects will be hereinafter referred to as effect programs. The change data read out from the storage device of the automatic performance section is program change data that instructs a change in the effect program. The processor per forms a control to sequentially read out the performance data from the storage device of the automatic performance section so that an automatic performance process corresponding to the read-out performance data is performed. Change in the designating data is instructed by change data that is read out from the storage device in accordance with the progression of the automatic performance process. Namely, the processor provides the DSP device with the designating data or effect program which corresponds to an effect designated by the change data or program change data, so that the DSP performs a process for imparting the designated effect.

In order to achieve the above-mentioned object, a tone signal processing device in accordance with another aspect of the present invention comprises an automatic performance section for generating an automatic performance tone signal on the basis of automatic performance data, an external sound inputting section for inputting a sound signal from outside the tone signal processing device, and an effect imparting section for imparting effects to the automatic performance tone signal and the sound signal independently of each other so that the effects imparted to the signals can be different from each other.

This tone signal processing device integrally incorporates therein the effect imparting section and the automatic performance section and can impart respective effects to the automatic performance tone signal and the external sound signal independently of each other so that the effects imparted to the signals can be different from each other. With such arrangements, it is possible to impart effects to an automatic performance tone and an external tone in a variety of combinations, which will be highly advantageous in a musical sense.

In order to achieve the above-mentioned object, a tone signal processing device in accordance with still another aspect of the present invention comprises an effect imparting section for imparting an effect designated by designating data, to a sound signal input from outside the tone signal processing device, an automatic performance section for performing an automatic performance process on the basis of automatic performance data, and a process order control section for controlling an order of processes in the automatic performance section and the effect imparting section in such a manner that the process in the automatic performance section is performed with priority over the process in the effect imparting section.

This tone signal processing device integrally incorporates therein the effect imparting section and the automatic performance section and also includes common hardware resources shared between these two sections. Accordingly, it may cause considerable inconveniences if a given process is performed in one of the sections regardless of the processing state in the other of the sections. So, the process order control section controls the order of the processes in the two sections in such a manner that the process in the automatic performance section is performed with priority over the process in the effect imparting section, to avoid competition between the processes in the two sections. Such a process order control allows an automatic performance process and an effect imparting process to be performed as if the two processes are performed simultaneously in a parallel fashion without any substantial inconvenience. The effect imparting section and the automatic performance section may be controlled by a single common processor or by separate processors.

In order to achieve the above-mentioned object, a tone signal processing device in accordance with still another aspect of the present invention comprises a pitch measuring section for detecting a zero-cross point of a sound waveform signal input from outside the tone signal processing device and calculating a pitch of the sound waveform signal on the basis of detected zero-cross point, an automatic performance section for performing an automatic performance process on the basis of automatic performance data, and a process order control section for controlling an order of processes in the pitch measuring section and the automatic performance section in such a manner that a zero-cross detecting process in the pitch measuring section is performed with priority over the process in the automatic performance section and that the process in the automatic performance section is performed with priority over a pitch calculating process in the pitch measuring section.

This tone signal processing device integrally incorporates therein the pitch measuring section for tuning and the automatic performance section. The pitch measuring section detects a zero-cross point of a sound waveform signal to calculate the pitch of the waveform signal, and the automatic performance section performs an automatic performance process on the basis of automatic performance data. By the process order control section, the order of processes in the pitch measuring section and the automatic performance section is controlled in such a manner that the zero-crossover detecting process in the pitch measuring section is performed with priority over the process in the automatic performance section and that the process in the automatic performance section is performed with priority over the pitch calculating process in the pitch measuring section. Such a process order control controls the tuning process and automatic performance process not to compete with each other and allows these two processes to be performed as if they are performed simultaneously in a parallel fashion.

Now, the preferred embodiment of the present invention will be described in full detail with reference to the accompanying drawings.

DETAILED DESCRIPTION OF THE PREFERRED EMBODIMENT

Figure 1:
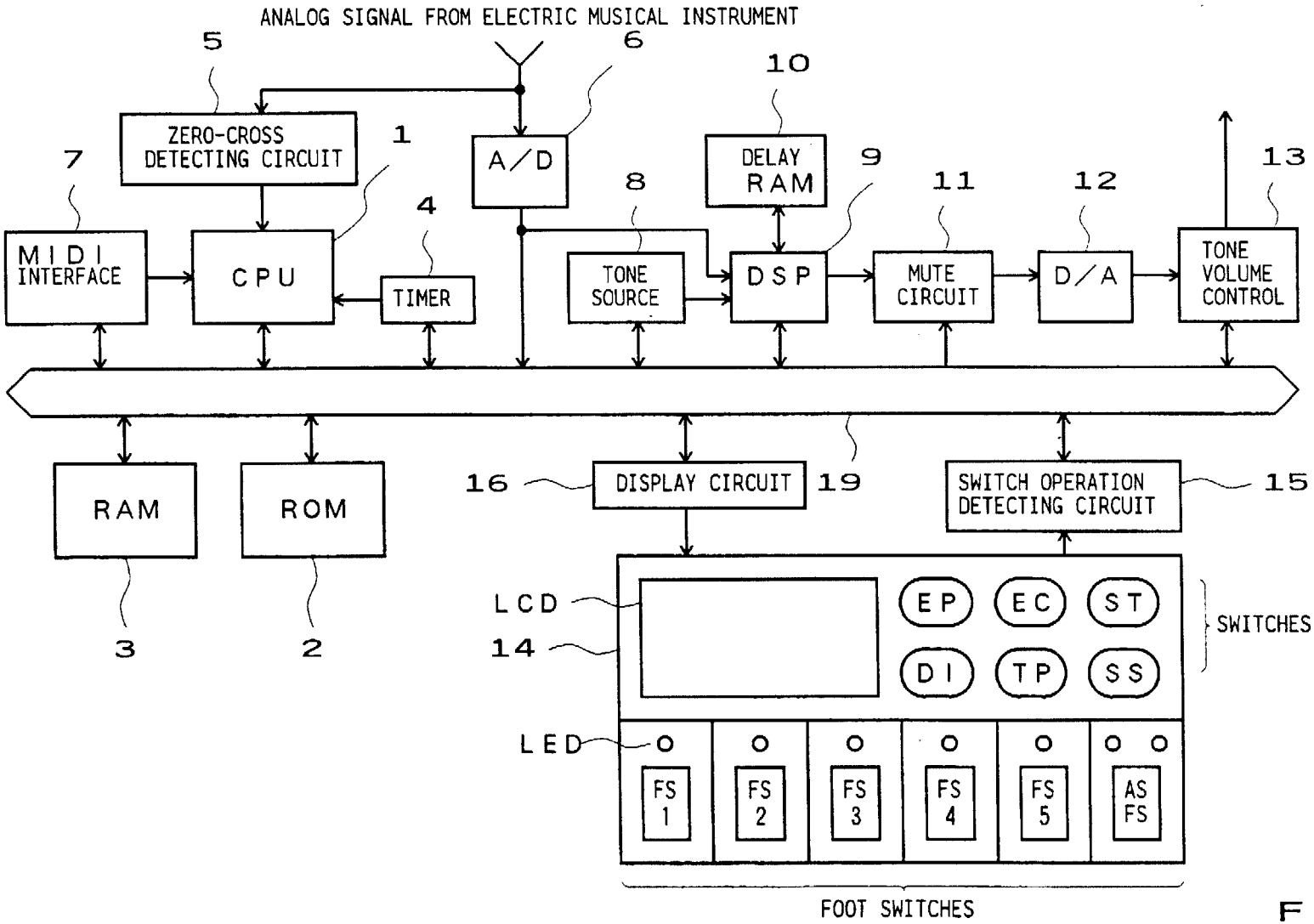
FIG. 1 is a hardware block diagram illustrating the over all structure of a tone signal Processing device in accordance with an embodiment of the present invention.

FIG. 1 is a hardware block diagram illustrating the overall structure of a tone signal processing device according to an embodiment of the present invention. The tone signal processing device of this embodiment is an effect imparting device provided with additional automatic performance and tuning functions; that is, this device is an integral combination of effect imparting, automatic performance and tuning devices.

A microprocessor unit (hereinafter referred to as a CPU) 1 controls the entire operation of the effect imparting device. To this CPU 1 are connected, via a data and address bus 19, a ROM 2, a RAM 3, a timer 4, an A/D (analog-to-digital) converter 5, a MIDI interface 7, a tone source circuit 8, a digital signal processor (DSP) 9, a mute circuit 11, a tone volume control circuit 13, a switch detecting circuit 15 and a display circuit 16.

Description will be given below on such an effect imparting device in which effect imparting, automatic performance and tuning processes are all carried out by a single CPU, but it should be understood that the principle of the present invention is also applicable to other effect imparting devices in which these processes are carried out by separate CPUs.

The ROM 2, which is a read-only memory, stores therein control programs for the CPU 1, plural microprograms to be set in the DSP 9 and various other data. Thus, in order to change effects to be imparted, it is sufficient to read out a corresponding microprogram from the ROM 2 and set the read-out microprogram in the DSP 9.

The RAM 3 includes a memory area used as various registers and flags for temporarily storing various data produced as the CPU 1 carries out the control programs, a memory area for storing automatic performance data and another memory area for storing effect parameters. Each set of the automatic performance data is composed of a pattern data section in which accompaniment pattern data are recorded and a song section in which the performance sequence or order of the pattern data is recorded in the progression order of the music piece. In the song section, there are also recorded other data such as data instructing the order of chord progression and program change data instructing a change in the effect to be imparted.

The timer 4 provides the CPU 1 with a timer interrupt command signal at predetermined time intervals that are set by the CPU 1.

A zero-cross detecting circuit 5 inputs thereto an analog signal (external sound sigal) generated from an electric musical instrument such as an electric guitar or an anolog sound signal picked up from any other external tone source or instrument through a microphone, and it detects zero-cross points in the waveform of the analog signal so as to calculate the pitch of the signal. Whenever the detecting circuit 5 detects a zero-cross point, it outputs an interrupt command signal to the CPU 1.

The A/D converter 6 converts the analog signal provided from the electric musical instrument into a digital signal, and it outputs the digital signal to the DSP 9 and to the CPU 1 via the data and address bus 19.

The MIDI interface 7 is an interface that received MIDI data from MIDI-corresponding external devices and outputs MIDI data to MIDI-corresponding external devices. The MIDI interface 7 outputs an interrupt command signal to the CPU 1 when MIDI data is input thereto from the external device.

The tone source circuit 8, which is capable of simultaneously generating tone signals through a plurality of tone generation channels, inputs thereto various performance data (such as note-on data, note number data, velocity data and waveform data which all conform to the MIDI standards), on the basis of which the circuit 8 generates tone signals for an automatic performance. The thus-generated tone signals are provided to the DSP 9.

To both the external sound signal provided from the A/D converter 6 and the automatic performance tone signal provided from the tone source 8, the DSP 9 imparts effects corresponding to the microprogram stored in its internal memory. The effect-imparted signals output from the DSP 9 are passed to a mute circuit 11. The DSP 9 performs different arithmetic operations on the external sound signal and the automatic performance tone signal so as to impart different effects to these two signals independently of each other. For example, by the DSP 9, the external sound signal is imparted a compressor, distortion, equalizer, chorus, reverberation effect or the like, and the automatic performance tone signal is imparted a reverb effect or the like. To this end, the DSP 9 is connected with a delay RAM 10 that is provided for delay and reverberation purposes.

The mute circuit 11 is provided for eliminating noises that may be produced when any of the microprograms of the DSP 9 is rewritten, and the circuit 11 has two separate systems for the external sound signal and automatic performance tone signal. The mute circuit 11 is normally in a mute-release (i.e., inactive) state, but when any of the microprograms of the DSP 9 is rewritten, circuitry of the system corresponding to the rewritten microprogram is brought into a mute (active) state. Thus, the signals having passed through the mute circuit 9 are provided via a D/A (digital-to-analog) converter 12 to the tone volume control circuit 13. The D/A converter 12 converts the digital signals which have passed through the mute circuit 11, into analog signals and outputs the analog signals to the tone volume control circuit 13. The tone volume control circuit 13 is provided for controlling the tone volume balance between the external sound signal and the automatic performance tone signal and outputs resultant analog signals to an external sound system etc.

A switch panel 14 is provided with an effect parameter setting switch EP, an effect changing switch EC, an automatic performance start/stop switch ST, an automatic performance data inputting switch DI, a tempo changing switch TP, foot switches FS1–FS5, an assigning foot switch ASFS and other operating members. The switch panel 14 is also provided with a liquid crystal display panel LCD, light emitting diodes LED. The liquid crystal display panel LCD is provided on the surface of the switch panel 14 for displaying an effect program number, parameters, automatic performance data, tempo, pitch of a detected external sound etc., while the light emitting diodes LED are provided above the foot switches FS1–FS5, ASFS for being lit to indicate which of the foot switches is currently in the ON state.

A switch operation detecting circuit 15 detects the operational state of each switch on the switch panel 14 so as to output a switch interrupt signal to the CPU 1 via the data and address bus 19. The display circuit 16 drives and controls the liquid crystal display panel LCD and light emitting diodes LED.

Next, with reference to flowcharts shown in FIG. 2 to FIG. 11, description will be made on an example of processing which is carried out by the CPU 1 in the effect imparting device of FIG. 1.

Figure 2:
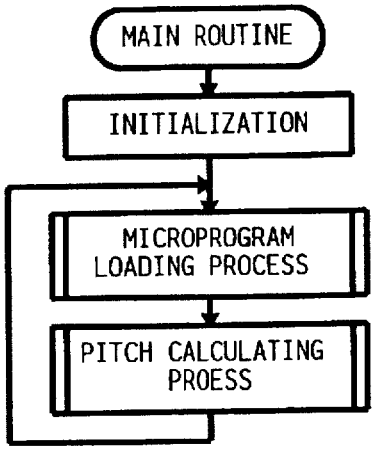
FIG. 2 is a flowchart of an example of a main routine carried out by a CPU shown in FIG. 1.
Figure 3:
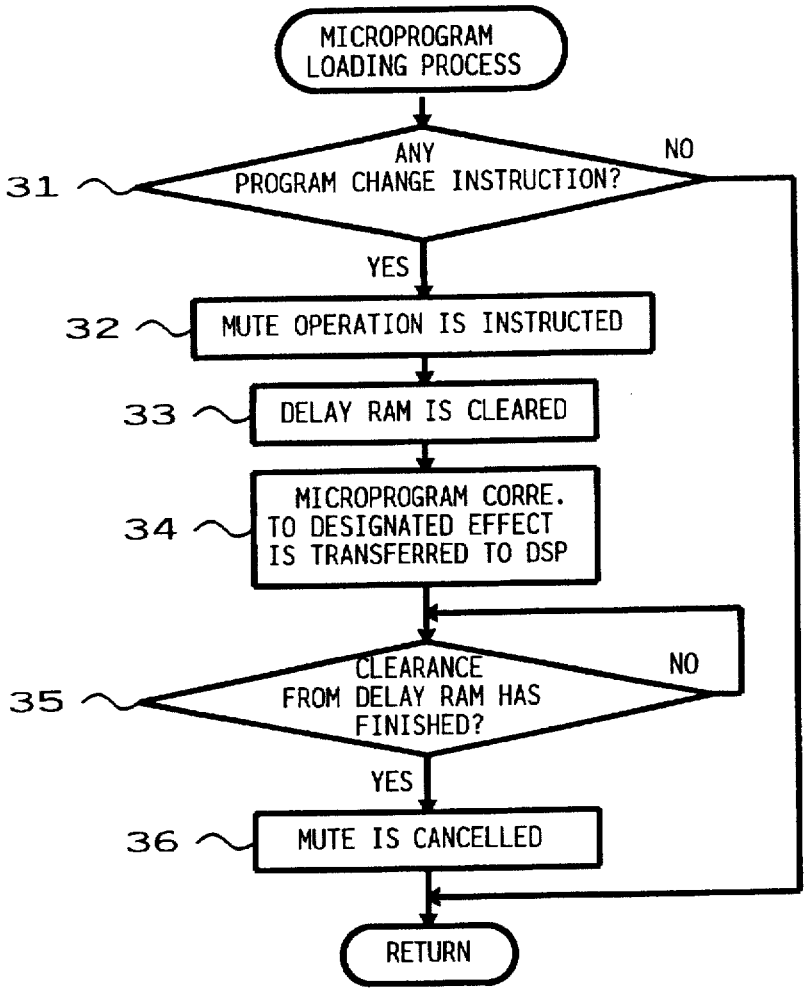
FIG. 3 is a flowchart illustrating the detail of a microprogram loading process shown in FIG. 2.
Figure 4:
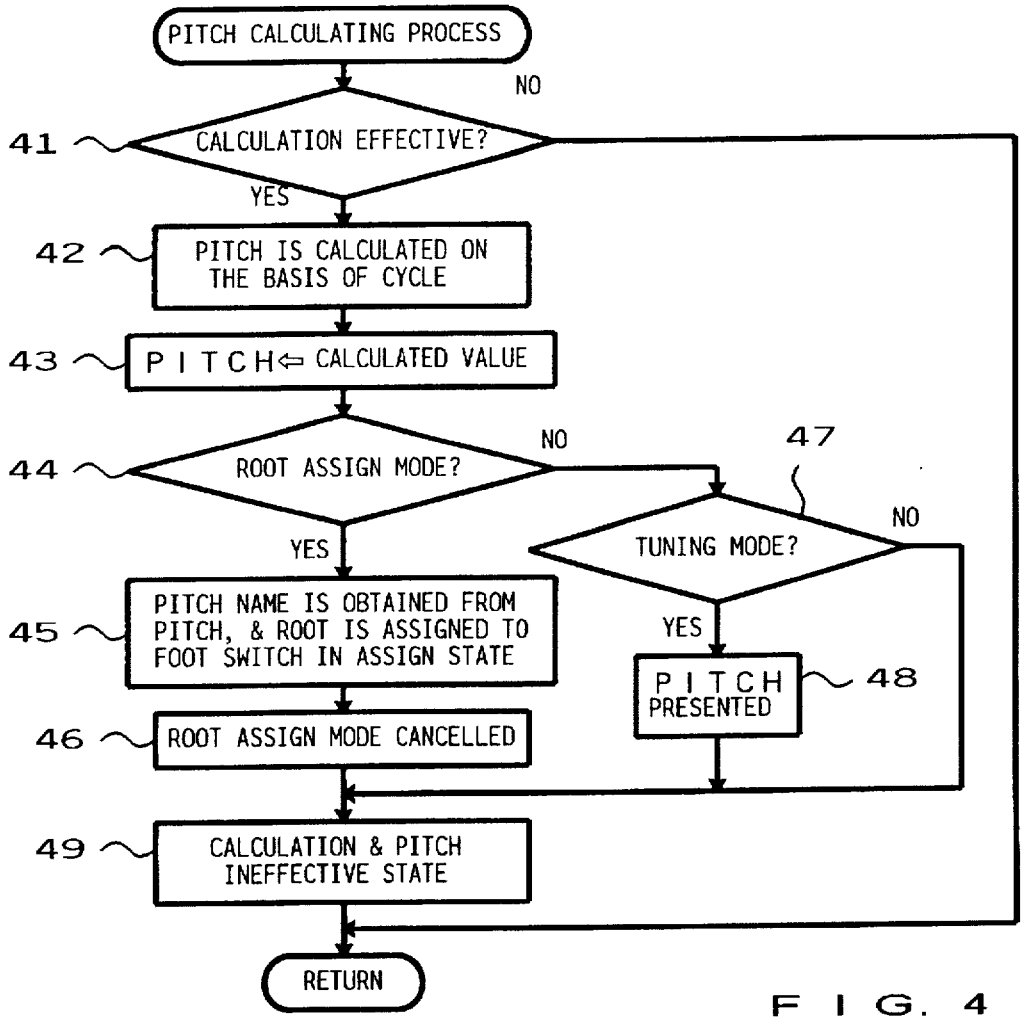
FIG. 4 is a flowchart illustrating the detail of a pitch calculating process shown in FIG. 2.

The processing carried out by the CPU 1 is composed of main routine processes illustrated in FIG. 2 to FIG. 4 and various interrupt processes illustrated in FIG. 5 to FIG. 11.

FIG. 2 is a flowchart of an example of a main routine carried out by the CPU 1.

In this main routine, upon powering, the CPU 1 is caused to start processes corresponding to the control programs stored in the ROM 2. First of all, the CPU 1 carries out an initialization process for initializing various registers and flags provided in the RAM 3. After the initialization process, the CPU 1 repetitively carries out a microprogram loading process and a pitch calculating process.

FIG. 3 is a flowchart illustrating the detail of the microprogram loading process of FIG. 2. The CPU 1 carries out this microprogram loading process in the following step sequence.

Step 31: A determination is made as to whether or not there is any program change instruction. With the affirmative determination (YES), the CPU 1 goes to a next step, but otherwise, the CPU 1 returns to the main routine to carry out the pitch calculating process. As will be apparent fromn the description below, the affirmative determination indicating that there is a program change instruction is obtained in such a case where the effect changing switch EC has been operated or actuated, or where receipt of a MIDI program change command has been detected during a MIDI interrupt process of FIG. 5 , or where program change data has been read out as performance data during an automatic performance process of FIG. 8, or where depression of any of the foot switches FS1–FS5 has been detected in an effect mode of the device during a switch-monitor interrupt process of FIG. 9.

With the determination at step 31 that there is a program change instruction, the CPU 1 executes an effect change process from step 32 to step 36, so as to rewrite the microprogram into a microprogram instructed.

Step 32: The CPU 1 instructs the mute circuit 11 to initiate a mute operation for eliminating noises produced during the microprogram rewriting. In response to such an instruction from the CPU 1, the mute circuit 11 applies a mute operation to the output data from the DSP 9.

Step 33: Data in the delay RAM 10 which have been used for the preceding effect are cleared because of the microprogram rewriting. Step 34: The microprogram corresponding to a designated effect is read out from the ROM 2 to be transferred and written into the internal memory of the DSP 9.

Step 35: A determination is made as to whether the data clearance from the delay RAM 10 at step 33 has finished or not. With the affirmative determination that the data clearance has finished (YES), the CPU 1 goes to a next step, but if NO, the CPU 1 loops back until the determination becomes YES.

Step 36: Si ce the microprogram rewriting process has finished, the CPU 1 instructs the mute circuit 11 to cancel or stop the mute operation.

FIG. 4 is a flowchart illustrating the detail of the pitch calculating process shown in FIG. 2. This pitch calculating process is carried out by the CPU 1 in the following step sequence.

Step 41: A determination is made as to whether or not the effect imparting device is currently in a calculation-effective state. If the device is currently in the calculation-effective state (YES), the CPU 1 goes to a next step, but if NO, the CPU 1 returns to the main routine to carry out the microprogram loading process. The affirmative determination indicating that the effect imparting device is in the calculation-effective state is obtained in such a case where a zero-cross point interrupt process of FIG. 6 has been carried out to store into a cycle register CYCLE a counted value for a half cycle of an input waveform.

Figure 12:
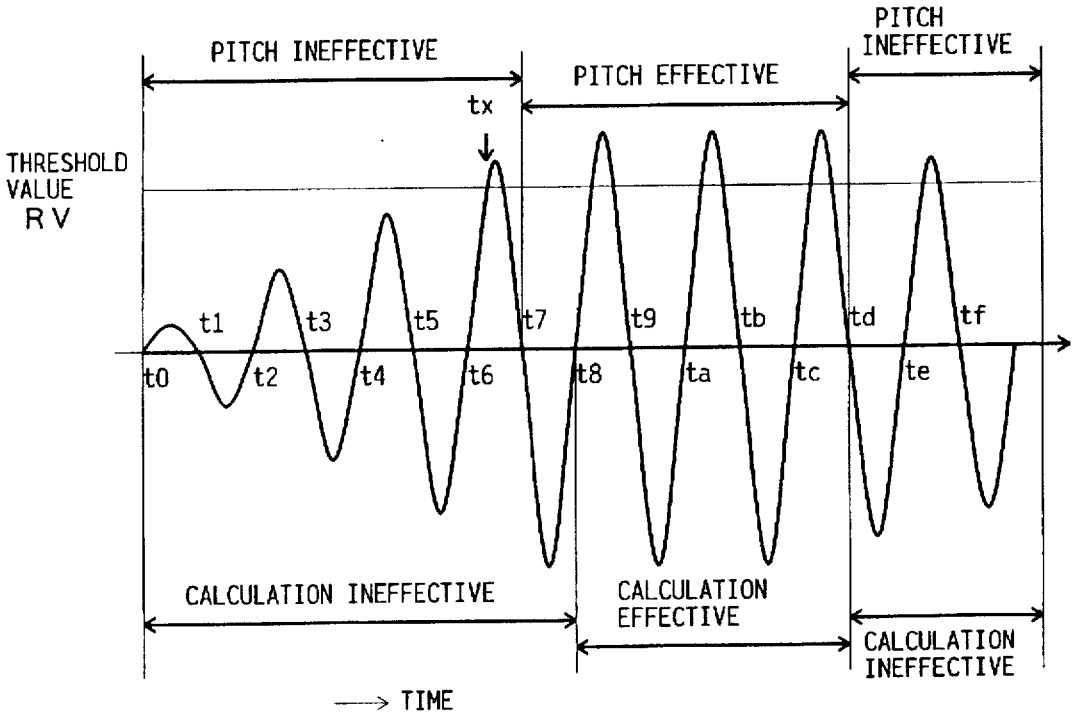
FIG. 12 illustrates an example of a waveform input from an external electric musical instrument to a zero-cross detecting circuit shown in FIG. 1.

In more specific terms, when a waveform as shown in FIG. 12 is in put from the external electric musical instrument to the zero-cross detecting circuit 5 and to the A/D converter 6, the CPU 1, instead of immediately carrying out the pitch calculating process, first determines on the basis of the output from the A/D converter 6 whether or not the amplitude value of the input waveform exceeds a predetermined threshold value RV. Once the amplitude value of the input waveform has exceeded the predetermined threshold value RV, the CPU 1, in response to a zero-cross interrupt signal provided from the detecting circuit 5, carries out the zero-cross interrupt process of FIG. 6, in which the CPU 1 stores into the cycle of the input waveform and counted value for a half cycle of the input waveform and then places the device in the calculation-effective state. The pitch calculating process is not carried out until the zero-cross interrupt process of FIG. 6 has generally been executed once. The zero-cross interrupt process of FIG. 6 will be described later in more detail.

Step 42: Here, because of the affirmative determination at step 41 that the device is in the calculation-effective state, the pitch of the input waveform is calculated on the basis of the half cycle count stored in the cycle register CYCLE. More specifically, the pitch is calculated using a plurality of the half cycle counts. In the example of FIG. 12, six counts of the cycle register CYCLE for time point t7 to tim e point td are used (averaged, for instance) to calculate the pitch. At this step 42, the CPU 1 returns to the main routine immediately after having accumulated one count of the cycle register CYCLE, until six counts have been accumulated.

Step 43: The calculated value, i.e., pitch data on the input waveform is stored into a pitch register PITCH.

Step 44: A determination is made as to whether or not the effect imparting device is in a root assign mode. With a determination of YES, the CPU 1 goes to next step 45, but with a determination of NO, the CPU 1 goes to step 48 by way of step 47.

Step 45: Because of the affirmative determination at the preceding step 44 indicating that the effect imparting device is in the root assign mode, a pitch name corresponding the pitch data stored in the pitch register PITCH is obtained, and a root corresponding to the obtained pitch name is set or assigned to any of the foot switches FS1–FS5 that is in the assign state.

Step 46: The root assign mode is cancelled.

Step 47: Because of the negative determination at the preceding step 44 indicating that the effect imparting device is not in the root assign mode, a further determination is made as to whether or not the device is in a tuning mode. The CPU 1 goes to step 48 if the device is in the tuning mode (YES), but it branches to step 49 if the device is not in the tuning state (NO).

Step 48: The pitch value corresponding to the pitch data stored in the pitch register PITCH is presented on the liquid crystal display panel LCD.

Step 49: The CPU 1 returns to the main routine after having placed the device in a calculation-ineffective state and in a pitch-ineffective state.

The interrupt processes of FIG. 5 to FIG. 11 are classified into processes of priority levels 1 to 6 in terms of their priorities. The interrupt process of priority level 1 has the lowest priority, and the interrupt process of priority level 6 has the highest priority.

Figure 7:
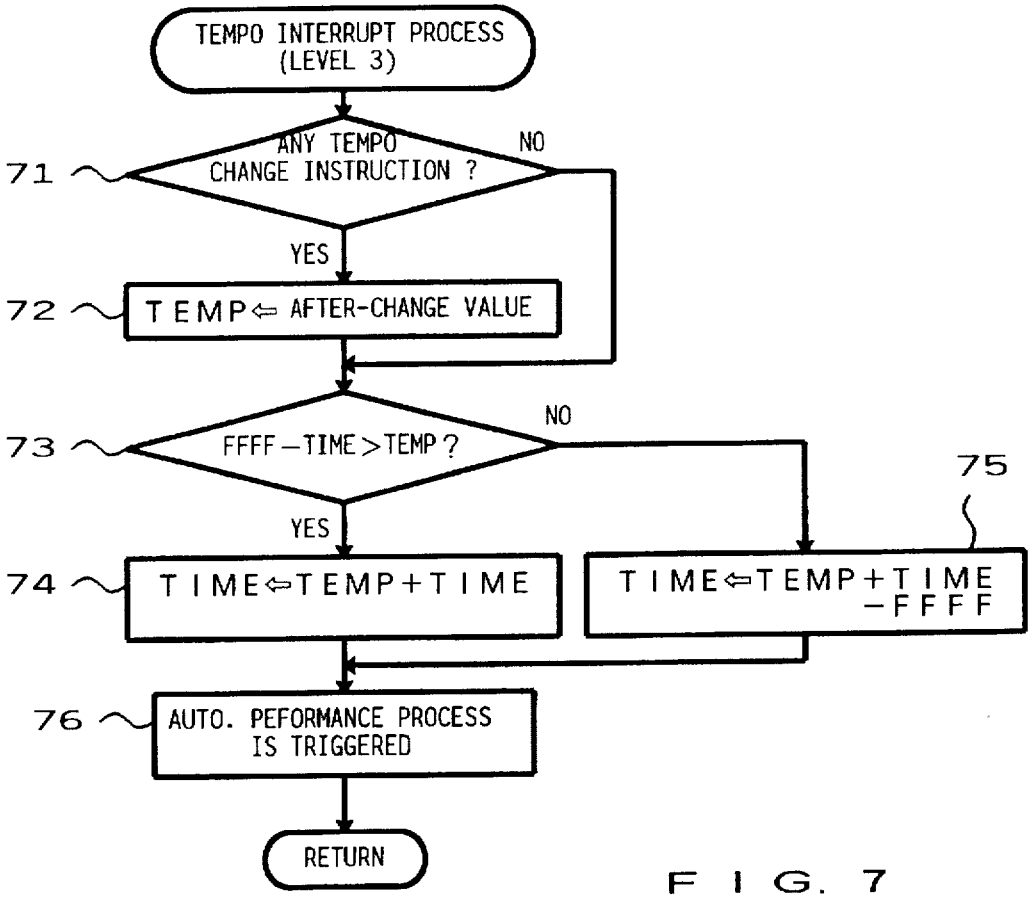
FIG. 7 is a flowchart illustrating the detail of a tempo interrupt process of priority level 3.
Figure 8:
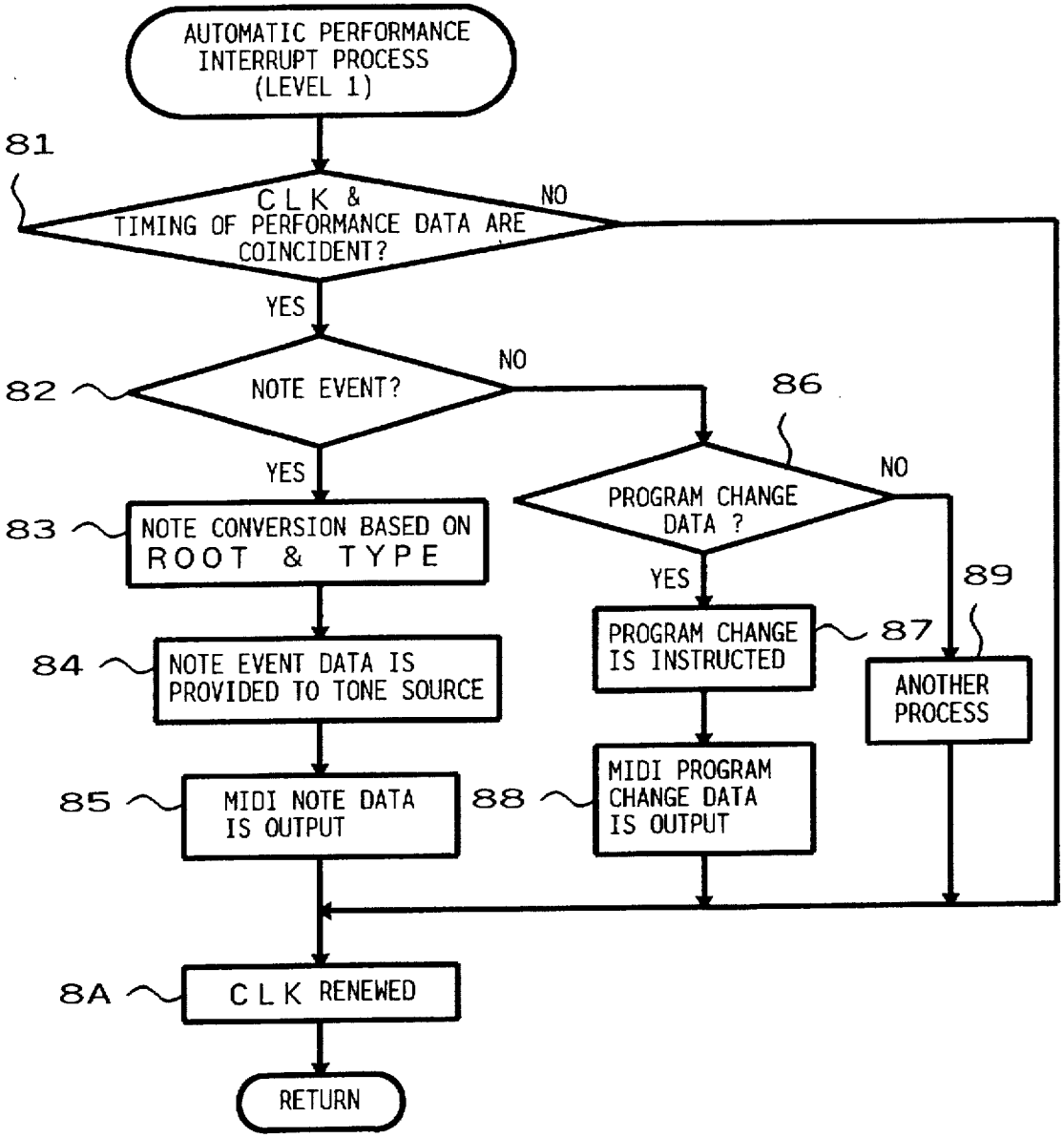
FIG. 8 is a flowchart illustrating the detail of an automatic performance interrupt process of priority level 1.
Figure 9:
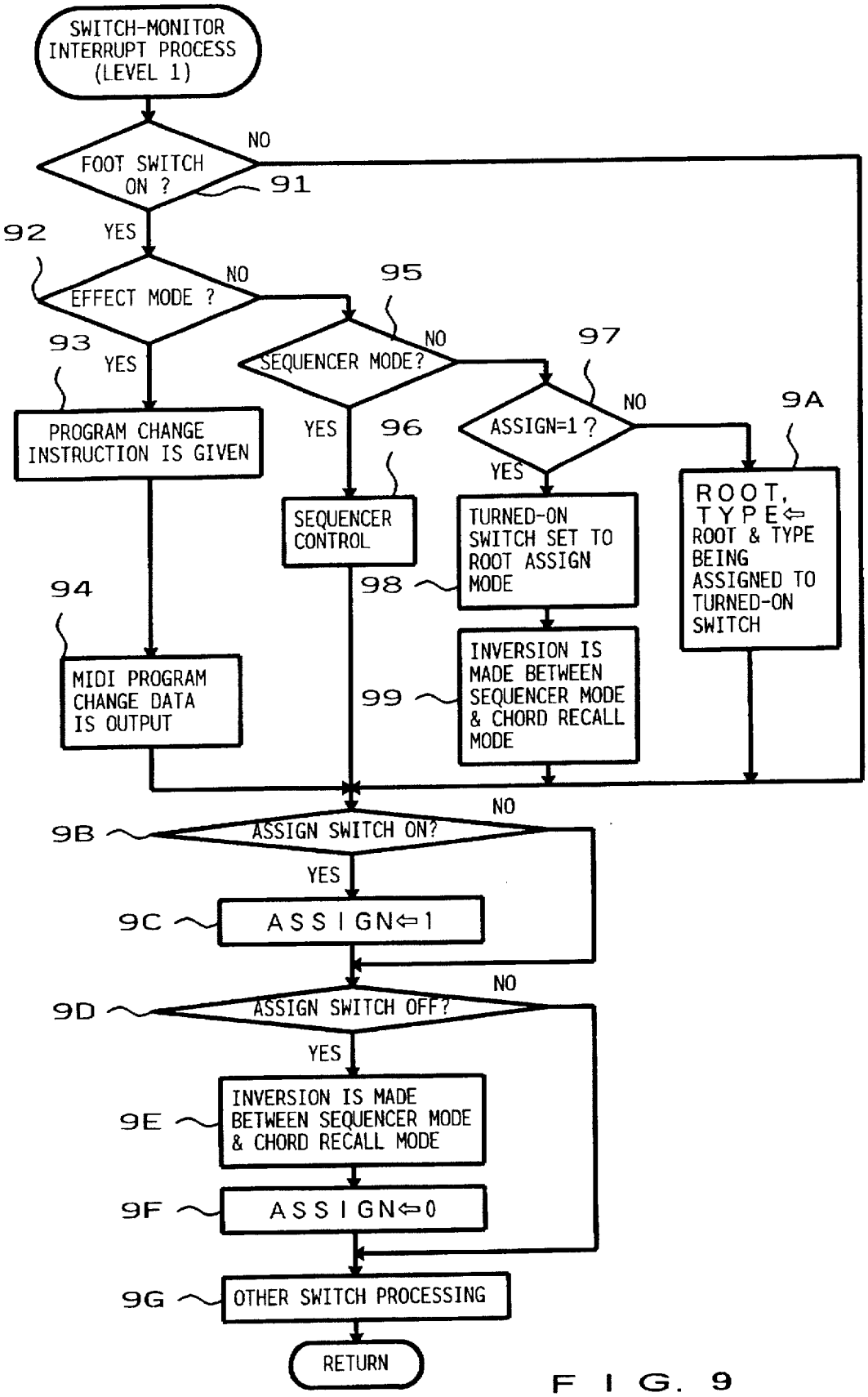
FIG. 9 is a flowchart illustrating the detail of a switch-monitor interrupt process of priority level 1.

An automatic performance interrupt process of FIG. 8 and the switch-monitor interrupt process of FIG. 9 are both classified as the interrupt process of priority level 1. The interrupt process of priority level 2 is a timer interrupt process 2 of FIG. 11 which is carried out at time intervals of 1.6 msec, and the interrupt process of priority level 3 is a tempo interrupt process of FIG. 7. Further, the interrupt process of priority level 5 is the zero-cross interrupt process of FIG. 6, and the interrupt process of priority level 6 is a MIDI interrupt process of FIG. 5.

Each of the interrupt processes can interrupt and hence can be executed with priority over any lower priority interrupt process, but it can not interrupt any higher priority interrupt process and hence must wait until the higher priority interrupt process has been completed.

Figure 5:
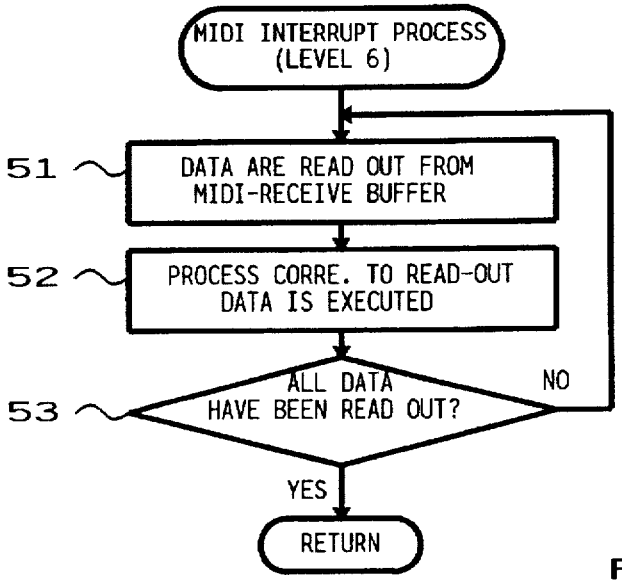
FIG. 5 is a flowchart illustrating the detail of a MIDI interrupt process of priority level 6.

In FIG. 5, there is illustrated the detail of the MIDI interrupt process of priority level 6, which is carried out with top priority so as not to cause any inconveniences such as undesired delayed sounding of tones. This MIDI interrupt process is triggered by a MIDI interrupt signal given to the CPU 1 from the MIDI interface when MIDI data are input from the MIDI instrument via the MIDI interface. The CPU 1 carries out the MIDI interrupt process in the following step sequence.

Step 51: MIDI data are read out from a MIDI-receive buffer of the MIDI interface 7.

Step 52: Processes corresponding to the read-out MIDI data are executed.

Step 53: A determination is made as to whether or not all data in the MIDI-receive buffer have been read out. if the answer is in the affirmative, the CPU 1 returns to carry out other interrupt processes and the main routine. But, if the answer is in the negative, then the CPU 1 loops back to step 51 to repetitively execute the operation of steps 51 to 53 until all the data in the buffer have been read out.

Figure 6:
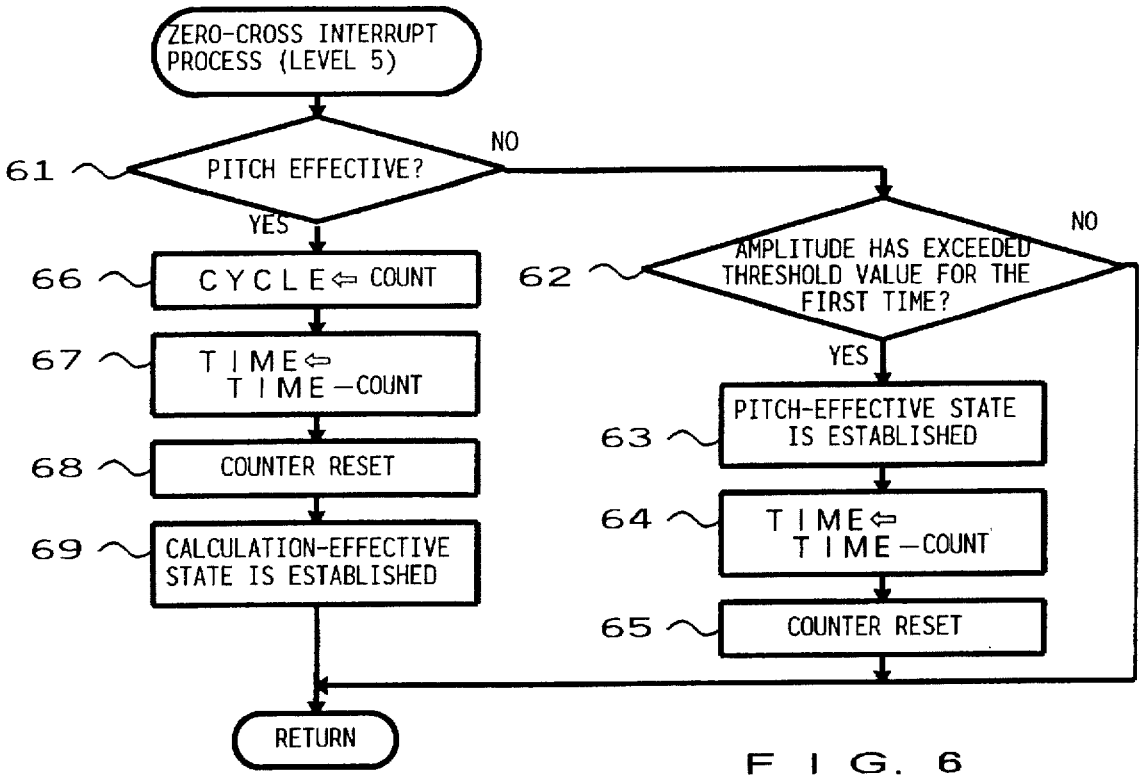
FIG. 6 is a flowchart illustrating the detail of a zero-cross interrupt process of priority level 5.

In FIG. 6, there is shown the detail of the zero-cross interrupt process of priority 5. This zero-cross interrupt process substantially affects the accuracy of tempo calculation and hence is carried out with the highest priority next to that of the MIDI interrupt process. The zero-cross interrupt process is triggered when a waveform as shown in FIG. 12 is input from the external electric musical instrument to the zero-cross detecting circuit 5, in synchronization with a zero-cross detection signal that is generated by the detecting circuit 5 each time the circuit 5 detects a zero-cross point of the input waveform. In the example of FIG. 12, the zero-cross detecting circuit 5 generates zero-cross detection signals at time points t0, t1, t2, t3, . . . At each of time points t0, t1, t2, t3, . . . , the CPU 1 carries out the zero-cross interrupt process in the following step sequence.

Step 61: It is determined whether or not the pitch is effective or not. The CPU 1 goes to step 66 if the pitch is effective (YES), but it branches to step 62 if the pitch is ineffective (NO). The pitch-effective state is established at the first zero-cross interrupt process after the waveform amplitude value has exceeds the threshold value, and the pitch-ineffective state is established at step 49 of the pitch calculating process of FIG. 4. In the case of the input waveform of FIG. 12, because the amplitude value exceeds the threshold value at time point tx, the pitch becomes effective at the next time point t7 and thus the pitch calculation of step 42 is performed at time points tc and td. Then, the pitch becomes ineffective at step 49. So, normally, a determination of NO indicating that the pitch is ineffective is obtained at step 61, so that the CPU 1 proceeds to step 62.

Step 62: A determination is made as to whether or not the amplitude value of the input waveform has exceeded the predetermined threshold value RV for the first time. The CPU 1 proceeds to step 63 if the answer is in the affirmative, but it returns to the main routine if the answer is in the negative. Because the CPU 1 makes this determination on the basis of the output value from the A/D converter 6, in all the zero-cross interrupt processes at time points t0–t6, the determination results of steps 61 and 62 are NO. A determination of YES is obtained at step 62A for time point t7 after time point tx when the amplitude value of the input waveform has exceeded the threshold value, and then operations of steps 63–65 are performed as follows.

Step 63: The pitch-effective state is established in the device to indicate that the input waveform amplitude value has exceeded the threshold value RV and a pitch measurement has been made effective. Accordingly, the CPU 1 resets a pitch measuring counter so that it is allowed to read a count of the counter at the next interrupt timing in order to measure a count for a half cycle of the input waveform. For instance, in the example of FIG. 12, the pitch measuring counter is reset at time point t7, and a count of the counter is read at the next zero-cross point time point t8 to measure the period of a half cycle of the input waveform.

According to this embodiment, a single 16-bit free run counter is shared for the zero-cross interrupt process of FIG. 6 and the tempo interrupt process of FIG. 7, in order to simplify the hardware structure of the effect imparting device. Namely, in this embodiment, the pitch counter for measuring the half cycle period of the input waveform is not separately provided from a tempo counter for generating a tempo interrupt signal; instead, only one counter is provided to measure the half cycle period and to generate a tempo interrupt signal in cooperation with a tempo interrupt timing register TIME. Thus, because of the shared counter, at next step 64, the value of the tempo interrupt timing register TIME is modified before the free run counter is reset.

Step 64: The counted value of the counter at the first zero-cross point time point after the amplitude value of the input waveform has exceeded the threshold value RV is subtracted from the value stored in the tempo interrupt timing register TIME, and then the value obtained from the subtraction (difference) is restored into the timing register TIME. More specifically, the timer 4 outputs a tempo interrupt signal to the CPU 1 at such a time point when the counted value of the pitch counter has equaled the value stored in the tempo interrupt timing register TIME. But, the counted value of the counter will be reset at next step 65 in the event that the zero-cross interrupt process is executed before the counted value of the pitch counter has equaled the value stored in the timing register TIME. Thus, at this step 64, the difference between the counted value and the value stored in the timing register TIME is stored as a new tempo interrupt signal into the timing register TIME before the counted value is reset.

Step 65: The counted value of the counter is reset in preparation for the next pitch measurement and next generation of tempo interrupt signal.

Step 66: The counted value of the counter is stored into the cycle register CYCLE. Because the counter has been reset in the preceding zero-cross point process, the pitch counter, at the time of the current zero-cross process, presents a counted value that corresponds to a time period from the preceding zero-cross process to the current zero-cross process. In the case of the input waveform shown in FIG. 12, a counted value corresponding to a time period from time point t7 to time point t8 is presented by the counter.

Step 67: Similarly to the previous step 64, because of the shared counter, the stored value of the tempo interrupt timing register TIME is modified before the counter is reset. Namely, the counted value of the counter corresponding to a timing when the zero-cross interrupt process has occurred is subtracted from the value stored in the tempo interrupt timing register TIME, and then the difference is restored into the timing register TIME.

Step 68: The counted value of the counter is reset, similarly to the previous step 65, in preparation for the next pitch measurement and next generation of tempo interrupt signal.

Step 69: The CPU 1 establishes the calculation-effective state in the effect imparting device and returns to the main routine. In the case of the input waveform shown in FIG. 12, the calculation-effective state is established at time point t8. After the calculation-effective state is established at time point t8, a YES determination is obtained at step 41 of the pitch calculating process of FIG. 4 and thus a pitch calculation is performed.

Figure 10:
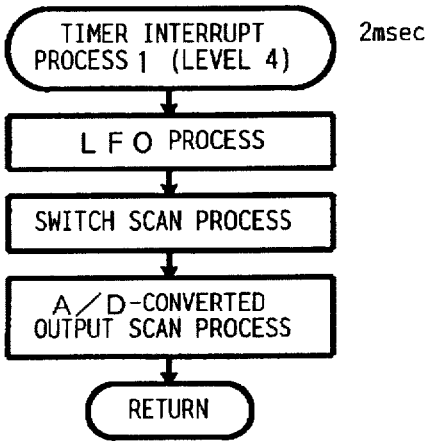
FIG. 10 is a flowchart illustrating the detail of a timer interrupt process 1 of priority level 4 which is carried out at time intervals of two milliseconds.

In FIG. 10, there is shown the detail of the timer interrupt process 1 of priority level 4 that is carried out at time intervals of two msec. This timer interrupt process 1 sequentially performs an LFO (low frequency oscillation) process, a switch scan process and an A/D-converted output scan process. In the LFO process, an output waveform is formed for oscillating the central frequency of a band-pass filter for achieving an auto wow effect. In the switch scan process, the switch detecting circuit 15 is scanned to detect the state of each switch on the switch panel 14. In the A/D-converted output scan process, detection is made of the amplitude value of the output from the A/D converter 6, i.e., of the input waveform from the electric musical instrument. The timer interrupt process 1 is assigned a relatively high priority because the LFO process must impart a smooth change to the output waveform and because scanning must be done at substantial y uniform time intervals in both the switch scan process and the A/D-converted output scan process. The switch-monitor interrupt process of FIG. 9 is executed on the basis of the result of the switch scan process, and the determination at step 62 of FIG. 6 is made on the basis of the result of A/D-converted output scan process.

Figure 11:
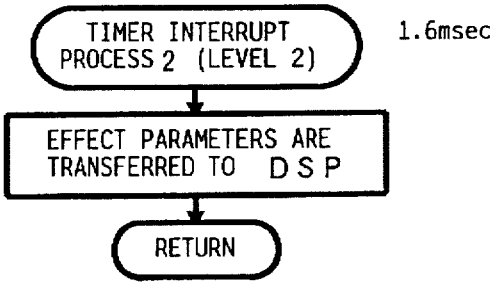
FIG. 11 is a flowchart illustrating the detail of a timer interrupt process 2 of priority level 2 which is carried out at time intervals of 1.6 milliseconds.

Further, in FIG. 11, there is shown the detail of the timer interrupt process 2 of priority level 2 that is carried out at time intervals of 1.6 msec. This timer interrupt process is a process for transferring (realtime) effect parameters to the DSP 9. The timer interrupt process, although it need not be performed precisely at uniform time intervals, is assigned priority level 2 since excessive irregularity in the transfer time intervals may cause an unnatural sound effect.

In FIG. 7, there is shown the detail of the tempo interrupt process of priority 3, which is a process for determining an automatic performance tempo and is assigned priority 3 so as to realize as accurate a tempo as possible. The tempo interrupt process is performed at interrupt intervals corresponding to the set value in the tempo register TEMP; for instance, this process is performed 24 times per quarter note. The following step sequence is followed by the CPU 1 to carry out the tempo interrupt process.

Step 71: A determination is made as to whether or not there is a tempo change instruction, i.e., whether or not the tempo changing switch TP has been operated on the switch panel 14. The CPU 1 proceeds to next step 72 with a determination of YES, but it jumps to step 73 with a determination of NO.

Step 72: Because of the determination at step 71 that there is a tempo change instruction, a tempo value changed in accordance with the operated amount of the tempo change switch TP is stored into the tempo register TEMP.

Step 73: Because, as mentioned earlier, a single free run counter is shared between the zero-cross interrupt process of FIG. 6 and the tempo interrupt process of FIG. 7 in this embodiment, it is determined at this step 63 whether or not the remaining value to be counted by the free run counter (FFFF−TIME) is greater than the value stored in the tempo register TEMP. The CPU 1 goes to step 74 with an affirmative determination but goes to step 75 with a negative determination.

Step 74: Because of the affirmative determination at the preceding step 73 that the remaining value (FFFF−TIME) is greater than the stored value of the tempo register TEMP, this step merely adds the stored value of the tempo register TEMP to the stored value of the timing register TIME and then stores the addition result (sum) as the next tempo interrupt timing into the timing register TIME.

Step 75: Because of the negative determination at the preceding step 73 that the remaining value (FFFF−TIME) is equal to or smaller than the stored value of the tempo register TEMP, this step merely adds the stored value of the tempo register TENIP with the stored value of the tempo interrupt timing register TIME, then subtracts the maximum count value FFFF of the free run counter from the sum, and then stores the difference as the next tempo interrupt timing into the timing register TIME.

Step 76: The automatic performance process is triggered. Namely, an automatic performance interrupt signal is generated to execute the automatic performance process of FIG. 8.

In FIG. 8, there is shown the detail of the automatic performance process of priority level 1, which is a process for sequentially reading out the performance data stored in memory for audible reproduction or sounding. Therefore, in this process, some degree of delay is allowable unless the delay is excessive. The CPU 1 carried out the automatic performance process in the following step sequence.

Step 81: A determination is made as to whether or not the value indicated by a clock register CLK and the timing of the performance data are coincident with each other. The CPU 1 proceeds to next step 82 with a determination of YES, but it jumps to step 8A with a determination of NO.

Step 82: Due to the determination at the preceding step 81 that the value indicated by a clock register CLK and the timing of the performance data are coincident with each other, it is further determined at this step whether or not the performance data is note event data. If the performance data is note event data (YES), the CPU 1 proceeds to next step 83, but if the answer is in the negative, the CPU 1 branches to step 86.

Step 83: Due to the determination at the preceding step 82 that the performance data is note event data, note conversion is executed on the basis of data stored in a root register ROOT and a type register TYPE.

Step 84: The note event data is provided to the tone source circuit 8.

Step 85: MIDI note data is output outside the device.

Step 86: Due to the determination at the previous step 82 that the performance data is not note event data, it is further determined at this step whether or not the performance data is program change data. The CPU 1 proceeds to step 87 if the performance data is program change data (YES), but if not, it branches to step 89.

Step 87: Due to the determination at the preceding step 86 that the performance data is program change data, the CPU 1 instructs a program change, in response to which the microprogram stored into the internal memory of the DSP 9 during the microprogram loading process is rewritten to an instructed microprogram and an effect change process is performed.

Step 88: MIDI program change data is output outside the device via the MIDI interface.

Step 89: Since the performance data is data other than note event data and program change data, another process is performed depending on the data.

Step 8A: The CPU 1 renews the clock register CLK and then returns to the main routine.

In FIG. 9, there is shown the detail of the switch monitor process of priority level 1, which is carried out when the switch scan process of FIG. 10 detects that any of the switches has been operated on the switch panel. Similarly to the automatic performance process of FIG. 8, some degree of delay is allowable in this process unless the delay is excessive.

According to this embodiment, the above-mentioned five foot switches FS1–FS5 function as effect program changing switches, automatic performance controlling switches, chord recalling switches and root assigning switches, depending on which operation mode the effect imparting device is. The functions of these switches will be described below.

When the effect imparting device is in the effect mode, the foot switches FS1–FS5 function as effect program changing switches. Namely, the foot switches FS1–FS5 are assigned different effects in advance, so that in response to operation of any of the foot switches, a microprogram corresponding to the effect assigned to the operated foot switch is read out from the ROM 2 and written into the DSP 9.

When the effect imparting device is in a sequencer mode for enabling an automatic performance, the foot switches FS1–FS5 function as automatic performance controlling switches. Namely, when the effect imparting device is operating in the sequencer mode, the effect is automatically changed, along with the progression of a music piece, by program change data stored among the performance data, and thus the above-mentioned effect program changing function is not needed any longer. Accordingly, in this sequencer mode, the foot switches FS1–FS5 function as, for example, automatic performance start/stop switches, a fill-in switch and song/pattern changing switches, respectively.

When the effect imparting device is in a chord recall mode, the foot switches FS1–FS5 function as chord recalling switches for recalling, on the realtime basis, chords (chord roots and types) assigned thereto in advance. Namely, when any of the foot switches is depressed to designate a chord while the effect imparting device is automatically performing an accompaniment pattern in this chord recall mode, each tone pitch of the accompaniment pattern is modified to another tone pitch corresponding to the designated chord so as to form a desired music piece. As an alternative, the effect imparting device may be caused to function as a chord sequencer by recording chords designated by the foot switches sequentially in the progression order of the music piece.

It should be understood that desired chords can be assigned to the foot switches FS1–FS5 by operating predetermined switches on the switch panel 14, although not specifically shown. In addition, the chord root can be designated by the pitch of a sound input from outside the device, as will be described in detail.

In this embodiment, the operation mode is changed between the sequencer mode and the chord recall mode each time the assigning switch ASFS provided adjacent to the foot switches FS1–FS5 is depressed. Namely, a depression of the assigning switch ASFS in the sequencer mode changes the operation mode to the chord recall mode, while a depression of the assigning switch ASFS in the chord recall mode changes the operation mode to the chord recall mode.

In the chord recal I mode, the foot switches FS1–FS5 also function as root assign switches for designating any of the foot switches which is in turn used for designating a chord root on the basis of the pitch of an input external sound. Namely, when any one of the foot switches FS1–FS5 is depressed in the chord recall mode with the assign switch depressed, the depressed foot switch is brought into the root assign mode. Upon detection of the pitch of an external sound, a pitch name corresponding to the detected pitch is assigned as a chord root to the depressed foot switch. However, at this time, the previously assigned chord type remains unchanged. In this way, a chord root to be assigned to any of the foot switches can be designated while the player is performing a music piece.

The CPU 1 carries out the switch-monitor interrupt process corresponding to the above-mentioned four functions in the following step sequence.

Step 91: A determination is made as to whether or not the switch operated on the switch panel 14 is any of the foot switches FS1–FS5. The CPU 1 proceeds to step 92 if the answer is in the affirmative, but it jumps to step 9B if the answer is in the negative.

Step 92: Because of the determination at the preceding step 91 that the operated switch is any of the foot switches FS1–FS5, it is further determined whether the current operation mode is the effect mode. The CPU 1 proceeds to next step 93 if the operation mode is the effect mode (YES) but branches to step 95 if the answer is NO.

Step 93: Due to the determination at the preceding step 92 that the current operation mode is the effect mode, a program change instruction is given along with data indicating the effect type assigned to the operated foot switch.

Namely, because the current operation mode is the effect mode, the foot switches FS1–FS5 are caused to function as effect program changing switches. Thus, by the microprogram loading process of FIG. 3, a microprogram corresponding to the effect-type indicating data is read out from the ROM 2 and written into the DSP 9.

Step 94: MIDI program change data and the effect-type indicating data are output outside the effect imparting device.

Step 95: Due to the determination at the preceding step 92 that the current operation mode is not the effect mode, it is further determined at this step whether or not the current mode is the sequencer mode. The CPU 1 proceeds to step 96 with a determination of YES but further branches to step 97 with a determination of NO.

Step 96: Because the current operation mode is the sequencer mode, the foot switches FS1–FS5 function as automatic performance controlling switches (automatic start/stop switches, fill-in switch, song/pattern changing switches etc.).

Step 97: Since the current operation mode has been determined as being the chord recall mode at steps 92 and 95, it is further determined at this step whether or not the assign flag ASSIGN is at "1". With a determination of NO the CPU 1 proceeds to step 9A, but with a determination of YES the CPU 1 proceeds to step 98.

Step 98: Since steps 92 and 95 have determined that the current operation mode is the chord recall mode and step 97 has determined that the assigning switch has been depressed, at this step, the depressed (turned-ON) foot switch is set to the assign mode.

Step 99: Inversion is made between the sequencer mode and the chord recall mode. Namely, at this time, because the current operation mode is the chord recall mode, the mode is changed to the sequencer mode. The changed mode will be restored by steps 9D and 9E at such a time point when the assigning switch ASFS is turned OFF.

Step 9A: Since steps 92 and 95 have determined that the current operation mode is the chord recall mode and step 97 has determined that the assigning switch has not been depressed, at this step, a chord recall process is performed for writing the chord root and type assigned to the operated (turned-ON) foot switch into the root register ROOT and the type register TYPE.

Step 9B: It is determined whether the assigning switch ASFS has been turned ON on the switch panel 14, i.e., whether the switch ASFS has turned from the non-depressed state to the depressed state. The CPU 1 proceeds to step 9C if the answer is YES, but it jumps to step 9D if the answer is NO.

Step 9C: Due to the determination at the preceding step 9B that the assigning switch ASFS has been turned ON, the assign flag ASSIGN is set to "1". This means that when any one of the foot switch FS1–FS5 is depressed while the assigning switch ASFS is ON, the operations of steps 98 and 99 are performed.

Step 9D: A determination is made as to whether the assigning switch ASFS has been turned OFF, i.e., the switch ASFS has turned from the depressed state to the non-depressed state. The CPU 1 proceeds to step 9E if the answer is YES, but it jumps to step 9G if the answer is NO.

Step 9E: Mode inversion is made between the sequencer mode and the chord recall mode. Namely, if the current mode is the sequencer mode, the mode is changed to the chord recall mode, and if the current mode is the chord recall mode, the mode is changed to the sequencer mode. Thus, although the operation mode is changed to the sequencer mode at step 9A, it is changed to the original chord recall mode at this step. So, even when the root assign mode has become effective during the chord recall mode, the chord recall mode is maintained.

Step 9F: Due to the determination at step 9D that the assigning switch ASFS has been turned OFF, the assign flag ASSIGN is reset to "0".

Step 9G: When the switch scan process of FIG. 10 has detected that operation has been made of any other switch than the foot switches FS1–FS5 and assigning switch ASFS, other switch processing is performed depending on the operated switch.

It is preferable that the automatic performance interrupt process of FIG. 8 is performed with priority over the microprogram loading process, i.e., effect changing process contained in the main routine of FIG. 2. Because, general ly accurate time is required to carry out automatic performances, although accurate time is not necessarily required for loading microprograms.

Further, it is preferable that the automatic performance interrupt process of FIG. 8 is performed with priority over the pitch calculating process contained in the main routine of FIG. 2, because accurate time (high speed) is not necessarily required for pitch calculation. It is further preferable that the zero-cross interrupt process of FIG. 6 is assigned a higher priority than the automatic performance interrupt process. Because, to detect the pitch of a tone signal of 440 Hz that may have a period of about 2.27 msec, for instance, it is necessary to measure times with much higher resolution; however, in the case of automatic performance, if the minimum resolution is 24 per quarter note and tempo is 120, the period will be about 20.83 msec, and so lower accuracy than the pitch detecting accuracy will not affect so much.

In the above-described embodiment, the pitch measurement enabled (pitch-effective) state is initialed only after the amplitude value of the waveform input from outside has exceeded the predetermined threshold value RV, because, for some period immediately after picking of a guitar or the like, the input waveform amplitude tends to be unstable and its pitch fluctuation may be rather intense. Thus, according to the embodiment, the pitch measuring process is performed only after the input waveform amplitude level has exceeded the threshold value RV and has become stable, in order to achieve higher pitch calculation accuracy. After one pitch measurement is made, a next pitch calculation is not performed until the input waveform amplitude again exceeds the threshold value RV. This is because pitch oscillation of the input waveform is unstable even in the decay portion of the sound and continued pitch calculation may often result in an unclear pitch display due to fluctuation, making it difficult to identify a root in the root assign process. Thus, in the embodiment, the pitch-effective state is established by one pitch measurement at a first zero-cross point after the amplitude value has exceeded the threshold value RV. As an alternative, the pitch measurement may be repetitively performed a predetermined number of times and the average pitch measurement is determined as a pitch.

Further, in the above-described embodiment, a single free run counter is shared between the zero-cross interrupt process and the tempo interrupt process, and the period between zero-cross points is calculated on the basis of the counts obtained at the time of the counter reset and at a next zero-cross time point; instead, the count at the preceding zero-cross time point may be stored so that the period may be calculated on the basis of a difference between the preceding count and the current count. The counter may be reset during the tempo interrupt process.

The priority levels of the respective processes need not necessarily be the same as those described in the embodiment. The essential point is that the automatic performance interrupt process is performed with priority over the micro-program loading process, the zero-cross interrupt process is performed with priority over the automatic performance interrupt process and the automatic performance interrupt process is performed with priority over the pitch calculating process.

Furthermore, although the embodiment has been described in connection with a case where a single CPU 1 performs various processes in accordance with their priorities, a multi-processor arrangement may be employed in such a manner that the priority levels of the respective processes may be controlled by the processors.

As may be apparent from the foregoing, the tone signal processing device according to the invention can simultaneouslly perform the automatic performance process and the effect imparting process. The tone signal processing device also can simultaneouslly perform the automatic performance process and the tuning process.

What is claimed is:

1. A tone signal processing device comprising:

pitch measuring means for detecting a zero-cross point of a sound waveform signal input from outside said tone signal processing device and calculating a pitch of the sound waveform signal on the basis of detected zero-cross point;

automatic performance means for performing an automatic performance process on the basis of automatic performance data; and process order control means for controlling an order of processes in said pitch measuring means and said automatic performance means in such a manner that a zero-cross point detecting process in said pitch measuring means is performed with priority over the process in said automatic performance means and that the process in said automatic performance means is performed with priority over a pitch calculating process in said pitch measuring means.

2. A tone signal processing device as defined in claim 1 wherein the zero-cross point detecting process in said pitch measuring means is performed each time a zero-cross point of the sound waveform signal occurs, and the process in said automatic performance means is performed at predetermined time intervals corresponding to a performance tempo.

3. A tone signal processing system comprising:

pitch detecting means for detecting a pitch of a sound waveform signal input from outside said tone signal processing system;

musical tone generation means for generating a musical tone; and parameter setting means for setting a parameter for use in said musical tone generation means, on the basis of the pitch detected by said pitch detecting means said parameter designating a root of chord tones.

4. A tone signal processing system as defined in claim 3 which further comprises plural switches to which plural chord root notes are assigned in advance in correspondence with said parameter, said plural switches being operated to designate any desired chord root note for the musical tone to be generated by said musical tone generation means.

5. A tone signal processing device comprising:

counting means for providing a count renewed at predetermined time intervals;

pitch measuring means for, on the basis of the count of said counting means, measuring a pitch of a sound waveform signal input from outside said tone signal processing device;

automatic performance means for, at predetermined time intervals based on the count of said counting means, performing an automatic performance process on the basis of automatic performance data; and count modifying means for modifying the count of said counting means when a process has been performed by either of said pitch measuring means and said automatic performance means.

6. A tone signal processing device comprising:

sound signal inputting means for inputting a sound signal from outside said tone signal processing device;

effect imparting means for imparting an effect to said sound signal input from outside said processing device in accordance with effect designating data provided to said effect imparting means;

storage means for storing automatic performance data and effect change control data representing at least one effect;

automatic performance means for reading said automatic performance data and said effect change control data from said storage means;

automatic performance tone signal generating means for generating an automatic performance tone signal in accordance with automatic performance data read from said storage means; and effect control means for changing said effect designating data provided to said effect imparting means to effect designating data corresponding to an effect represented by said effect change control data read from said storage means.

7. A tone signal processing device as defined in claim 6 further comprising:

second storage means for storing said effect designating data provided to said effect imparting means;

third storage means for storing a plurality of effect designating data each corresponding to a different effect, wherein said effect control means changes said effect designating data provided to said effect imparting means by writing effect designating data from said third storage means to said second storage means, said written effect designating data corresponding to said effect represented by said effect change control data read from said storage means.

8. A tone signal processing device as defined in claim 6 wherein said effect imparting means comprises a digital signal processor device, and said effect designating data comprises a micro program.

9. A tone signal processing device as defined in claim 8 wherein said effect control means changes the micro program supplied to said digital signal processor device in accordance with said effect change control data read from said storage means.

10. A tone signal processing device as defined in claim 6 wherein said effect change control data is stored in said storage means in correspondence with a position in said automatic performance data at which an effect is to be imparted.

11. A tone signal processing device as defined in claim 6 wherein said automatic performance tone signal generated by said automatic performance tone signal generating means is provided to said effect imparting means and said effect imparting means imparts an effect to said automatic performance tone signal.

12. A tone signal processing device as defined in claim 6 which further comprises:

effect selecting means for selecting a desired effect; and mode changing means for changing an operation mode of said tone signal processing device to either a first mode in which effect designating data corresponding to an effect selected by said effect selecting means is provided to said effect imparting means in a second mode in which effect designating data in accordance with said effect change control data read from said storage means is provided to said effect imparting means.

13. A tone signal processing device comprising:

storage means for storing automatic performance data and effect change data representing at least one effect;

automatic performance means for generating an automatic performance tone signal in accordance with automatic performance data read from said storage means;

sound signal inputting means for inputting a sound signal from outside said tone signal processing device;

effect imparting means for imparting at least one effect to at least one of said automatic performance tone signal and said sound signal in accordance with effect designating data provided to said effect imparting means;

effect control means for controlling said effect imparting means so that respective effects to be imparted to said automatic performance tone signal and said sound signal can be different from each other; and effect change control means for changing at least a portion of said effect designating data provided to said effect imparting means to effect designating data corresponding to an effect represented by effect change data read from said storage means.

14. A tone signal processing device as defined in claim 13 further comprising volume control means for controlling a volume balance between said automatic performance tone signal and said sound signal.

15. A tone signal processing device comprising:

effect imparting means for imparting an effect designated by effect designating data to a sound signal input from outside said tone signal processing device;

automatic performance means for performing an automatic performance process in accordance with automatic performance data; and process order control means for controlling said automatic performance means and said effect imparting means such that processing in said automatic performance means is performed with priority over processing in said effect imparting means.

16. A tone signal processing device as defined in claim 15 wherein said effect imparting means comprises a digital signal processor device, and said effect designating data comprises a micro program.

17. A tone signal processing device as defined in claim 15 wherein processing in said automatic performance means is performed by interrupting processing in said effect imparting means at predetermined time intervals.

18. A tone signal processing device comprising:

a pitch stable portion identifying means for identifying a portion of a sound waveform signal input from outside said processing device having an amplitude that exceeds a predetermined threshold;

pitch determining means, responsive to said pitch stable portion identifying means, for determining a pitch of said portion identified by said identifying means;

storage means for storing automatic performance data; and automatic performance tone signal generating means for generating an automatic performance tone signal in accordance with automatic performance data read from said storage means.

19. A tone signal processing device as defined in claim 18 which further comprises invalidation means for, once a pitch of said portion has been determined by said pitch determining means, invalidating a further pitch determination until a new sound waveform signal is input.

20. A tone signal processing device comprising:

a pitch stable portion identifying means for identifying a portion of a sound waveform signal input from outside said processing device having an amplitude that exceeds a predetermined threshold;

Pitch determining means, responsive to said pitch stable portion identifying means, for determining a pitch of said portion identified by said identifying means;

storage means for storing automatic performance data;

automatic performance tone signal generating means for generating an automatic performance tone signal in accordance with automatic performance data read from said storage means; and process order control means for controlling said pitch measuring means and said automatic performance tone signal generating means such that processing in said automatic performance tone signal generating means is performed with priority over processing in said pitch measuring means.

21. A tone signal processing device comprising:

a sound signal input device for inputting a sound signal from outside said tone signal processing device;

a storage device for storing automatic performance data and effect change data for changing an effect to be imparted to said sound signal;

an automatic performance device for generating an automatic performance tone signal in accordance with automatic performance data read from said storage device;

an effect imparting device for imparting an effect to said sound signal in accordance with effect designating data provided to said effect imparting device;

an effect changing device for changing said effect designating data provided to said effect imparting device in accordance with effect change data read from said storage device; and a volume control device for controlling a volume balance between said automatic performance tone signal and said sound signal.

22. A tone signal processing device comprising:

a sound signal input device for inputting a sound signal from outside said tone signal processing device;

a storage device for storing automatic performance data and effect change data for changing an effect to be imparted to said sound signal;

an automatic performance device for generating an automatic performance tone signal in accordance with automatic performance data read from said storage device;

an effect imparting device for imparting an effect to said sound signal in accordance with effect designating data provided to said effect imparting device;

an effect changing device for changing said effect designating data provided to said effect imparting device in accordance with effect change data read from said storage device; and a muting device for muting said sound signal while effect designating data provided to said effect imparting device is being changed.

23. A tone signal processing device comprising:

a sound signal input device for inputting a sound signal from outside said tone signal processing device;

a storage device for storing automatic performance data and effect change data;

an automatic performance device for generating an automatic performance tone signal in accordance with automatic performance data read from said storage device; and an effect imparting device for imparting a first effect to said automatic performance tone signal and a second effect to said sound signal, wherein said first and second are changeable in accordance with effect change data read from said storage device.

24. A tone signal processing device according to claim 23 further comprising:

a volume balance control device for controlling a volume balance between said automatic performance tone signal to which said first effect has been imparted and said sound signal to which said second effect has been imparted.

25. A tone signal processing device according to claim 23 further comprising:

a muting device for muting at least one of said sound signal and said automatic performance tone signal while one of said first and said second effects are being changed.

26. A tone signal processing device according to claim 23, wherein said first effect and said second effect are a same effect.

27. A tone signal processing device according to claim 23, wherein said first effect and said second effect are different effects.

28. A tone signal processing device comprising:

a sound signal input device for inputting a sound signal from outside said tone signal processing device;

a storage device for storing automatic performance data and effect change data;

an automatic performance device for generating an automatic performance tone signal in accordance with automatic performance data read from said storage device;

an effect imparting device for imparting a first effect to at least one of said automatic performance tone signal and said sound signal;

an effect change signal input device for inputting, from outside said tone signal processing device, a change signal for changing said first effect; and an effect controller for changing said first effect in accordance with one of effect change data read from said storage device and said change signal input by said effect change signal input device.

29. A tone signal processing device according to claim 28, wherein said effect imparting device imparts a second effect to the other of said automatic performance tone signal and said sound signal.

30. A tone signal processing device according to claim 29 wherein said first effect and said second effect are a same effect.

31. A tone signal processing device according to claim 29 wherein said first effect and said second effect are different effects.

32. A tone signal processing device according to claim 28, wherein, while said automatic performance device generates said automatic performance tone signal, said effect controller changes said effect to be imparted to at least one of said automatic performance tone signal and said sound signal, in accordance with effect change data read from said storage device.

33. A tone signal processing device comprising:

a sound signal input device for inputting a sound signal from outside said tone signal processing device;

a storage device for storing automatic performance data and effect change data;

an automatic performance device for generating an automatic performance tone signal in accordance with automatic performance data read from said storage device;

an effect imparting device for imparting a first effect to at least one of said automatic performance tone signal and said sound signal;

an effect selecting device for selecting a second effect; and an effect controller for changing said first effect in accordance with at least one of effect change data read from said storage device and said second effect selected by said effect selecting device.

* * * * *